US007108064B2

(12) United States Patent
Hart et al.

(10) Patent No.: US 7,108,064 B2
(45) Date of Patent: Sep. 19, 2006

(54) MILLING TOOL INSERT AND METHOD OF USE

(75) Inventors: Shane P. Hart, Dubai (AE); Mark W. Schnitker, Friendswood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/680,725

(22) Filed: Oct. 7, 2003

(65) Prior Publication Data

US 2004/0129420 A1 Jul. 8, 2004

Related U.S. Application Data

(60) Provisional application No. 60/417,594, filed on Oct. 10, 2002.

(51) Int. Cl.
*E21B 10/46* (2006.01)

(52) U.S. Cl. ..... 166/298; 166/55.8; 175/426

(58) Field of Classification Search ..... 166/55.6, 166/55.7, 298; 175/426, 431, 432
See application file for complete search history.

(56) References Cited

U.S. PATENT DOCUMENTS

| | | | | |
|---|---|---|---|---|
| 4,499,958 A | | 2/1985 | Radtke et al. | |
| 4,529,048 A | | 7/1985 | Hall | |
| 4,753,305 A | | 6/1988 | Fisher | |
| 5,058,666 A | * | 10/1991 | Lynde et al. | 166/55.6 |
| 5,070,952 A | * | 12/1991 | Neff | 175/426 |
| 5,244,039 A | | 9/1993 | Newton, Jr. et al. | |
| 5,626,189 A | | 5/1997 | Hutchinson | 166/55.6 |
| 5,778,995 A | | 7/1998 | McGarian | 175/420.1 |
| 5,908,071 A | * | 6/1999 | Hutchinson et al. | 166/55.6 |
| 5,984,005 A | | 11/1999 | Hart et al. | 166/55.6 |
| 6,068,072 A | | 5/2000 | Besson et al. | |
| 6,170,576 B1 | * | 1/2001 | Brunnert et al. | 166/298 |

FOREIGN PATENT DOCUMENTS

| | | |
|---|---|---|
| EP | 0 339 776 | 11/1989 |
| EP | 0 351 952 | 1/1990 |
| GB | 2 270 097 | 3/1994 |

OTHER PUBLICATIONS

U.K. Search Report, Application No. GB 0323837.5, dated Feb. 5, 2004.

* cited by examiner

*Primary Examiner*—William Neuder
(74) *Attorney, Agent, or Firm*—Patterson & Sheridan LLP

(57) ABSTRACT

The present invention generally relates to a cutting insert for use with wellbore milling tools. The cutting insert forms an angle between a milling surface of the insert and a surface of the tool that the insert is attached to in order to provide the proper cutting incline, and substantially perpendicular sides of the insert relative to the milling surface of the insert provide continuous support for the milling surface. In addition, the inserts can comprise spacers and legs that evenly distribute bonds formed between inserts and bonds formed between the inserts and the surface of the tool, respectively. Selecting the dimensions of the spacers and legs alters the strength of the bonds.

20 Claims, 2 Drawing Sheets

MILLING TOOL INSERT AND METHOD OF USE

CROSS-REFERENCE TO RELATED APPLICATIONS

This application claims benefit of U.S. provisional patent application Ser. No. 60/417,594, filed Oct. 10, 2002, which is herein incorporated by reference.

BACKGROUND OF THE INVENTION

1. Field of the Invention

Embodiments of the present invention generally relate to cutting inserts for use with wellbore milling tools.

2. Description of the Related Art

Oil and gas wells typically begin by drilling a borehole from the earth's surface to some predetermined depth adjacent a hydrocarbon-bearing formation. After the borehole is drilled to a certain depth, steel tubing or casing is typically inserted in the borehole to form a wellbore. Various completion and production operations occur within the wellbore that require the use of milling tools.

Milling tools can be used to cut out windows or pockets from a tubular for such operations as directional drilling and sidetracking. In addition, mills can remove materials downhole such as pipe, casing, casing liners, tubing, or jammed tools by milling through them. Milling tools have been used for removing a section of existing casing from a wellbore, to provide a perforated production zone at a desired level, to provide cement bonding between a small diameter casing and the adjacent formation, or to remove a loose joint of surface pipe. Also, milling tools can be used for milling or reaming collapsed casing, for removing burrs or other imperfections from windows in the casing system, for placing whipstocks in directional drilling, or for aiding in correcting dented or irregular areas of a tubular. These milling tools have cutting blades or surfaces and are lowered into the well or casing and then rotated in a milling/cutting operation. With certain tools, a suitable drilling fluid is pumped down a central bore of a tool for discharge beneath the cutting blades or surfaces and an upward flow of the discharged fluid in the annulus outside the tool removes from the well cuttings or chips resulting from the cutting operation.

Several different types of inserts currently exist for use on a milling tool. Inserts are typically elements made of very hard material such as tungsten carbide. These inserts are typically welded or bonded to a portion of the mill such as a blade or tip. Therefore, the completed blade portion of the mill comprises three layers of materials including the blade that is usually steel, the bonding material that is usually brass, and the insert that is usually tungsten carbide. Differences in thermal expansion of these three layers can cause delaminating to occur at the bond surfaces or stress cracks in the inserts or blades on the mill that adversely affect the mill performance. Sections of carbide blade that detach from the tool may have to be retrieved from the wellbore at significant costs.

Surfaces on inserts that contact the material being milled include flat planar surfaces, convex surfaces, concave surfaces, or various other geometrical shapes advantageous to the cutting process. Certain of these inserts have surface irregularities, recesses, or indentations that serves as a chipbreaker to break a cutting being produced by an insert to limit the length of the cuttings. The inserts must be positioned on the blade of the mill with the proper cutting angle. Therefore, inserts can be formed with angled surfaces that contact the material being milled by adding material to one side of the insert to form an angled surface. In addition, milling slots in a vertical blade, leaning blades at an angle, or spiraling blades around a mill body can place the inserts at the correct cutting angle while adding further expense to the manufacture of the mill. However, the force during milling that acts on the surface of prior insert designs breaks off the edge formed by the tallest portion since there is minimal material to support the force acting on the edge.

Therefore, there exists a need for an improved apparatus for use in milling operations in a wellbore. There is a further need for an improved and more reliable cutting insert for a tool used in wellbore milling operations.

SUMMARY OF THE INVENTION

The present invention generally relates to a cutting insert for use with wellbore milling tools. The cutting insert forms an angle between a milling surface of the insert and a surface of the tool that the insert is attached to in order to provide the proper cutting incline, and substantially perpendicular sides of the insert relative to the milling surface of the insert provide continuous support for the milling surface. In addition, the inserts can comprise spacers and legs that evenly distribute bonds formed between inserts and bonds formed between the inserts and the surface of the tool, respectively. Selecting the dimensions of the spacers and legs alters the strength of the bonds.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
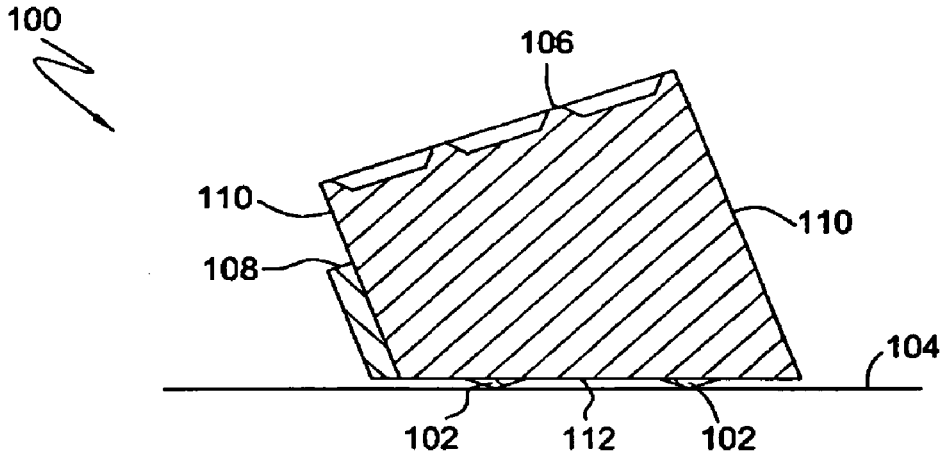
FIG. 1 is a section view of a side of a milling insert.

The present invention generally relates to cutting inserts for use with wellbore milling tools. FIG. 1 is a side view of an insert 100 with legs 102 contacting a mounting surface of a tool 104 such as a blade of a mill, milling surface 106, and spacers 108. The milling surface 106 forms a substantially perpendicular relationship with sides 110 of the insert 100. In order to establish the proper cutting angle of preferably between 7° and 8° for the milling surface 106, the sides 110 are angled relative to a base 112 of the mill insert 100. This design makes the milling surface 106 non-parallel to the base 112. Therefore, the design shown in FIG. 1 for the milling insert 100 provides substantially continuous support of the milling surface 106 since the sides 110 are substantially parallel to the force acting on the surface 106.

Figure 5:
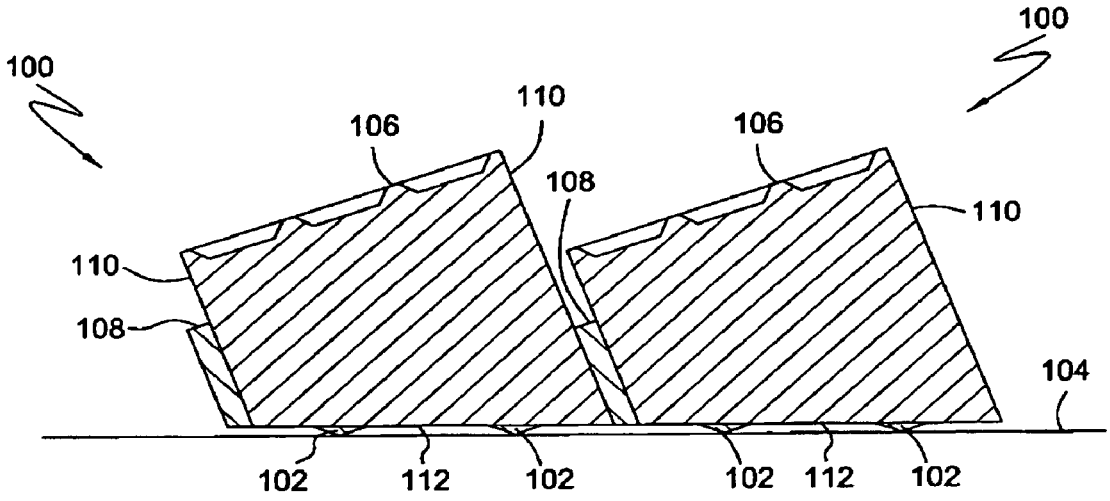
FIG. 5 is a view of a side of two adjacent milling inserts.

As shown in FIG. 1, the legs 102 and spacer 108 may be formed integrally with the rest of the insert 100 by using a single mold that forms the entire insert 100. Alternatively, the spacer 108 and/or the legs 102 can be added to the insert 100 in a separate process. Depending on how the mill insert 100 is arranged on the mill blade with respect to other mill inserts (not shown), additional spacers 108 may be added to an adjacent side of the mill insert 100. Legs 102 provide an evenly distributed bond to be made between the base 112 of the mill insert 100 and the blade of the mill 104 once the mill insert 100 is bonded to the mill by such methods as brazing or welding. Changing the height of the legs 102 alters the bond strength created between the mill insert 100 and mill blade 104. Bond strength maximizes between surfaces separated by 0.0005 inches to 0.002 inches and decreases if the separation exceeds 0.015 inches. Therefore, the legs 102 preferably have a height of 0.005 inches in order to provide a separation between the base 112 and the mill blade 104 that establishes a high bond strength once brazed. Similarly, spacers 108 evenly distribute the bond to be made between inserts, and altering the length of the spacers 108 adjusts the bond strength created between the mill insert 100 and additional mill inserts adjacently positioned. FIG. 5 shows two adjacent milling inserts 100 and the spacer 108 of one of the inserts in contact with the other insert. Selecting a spacer with a length of preferably 0.015 inches provides a more pliable bond, allows some flexure between inserts, and forms a better bond with the blade 104 than between inserts.

Figure 2:
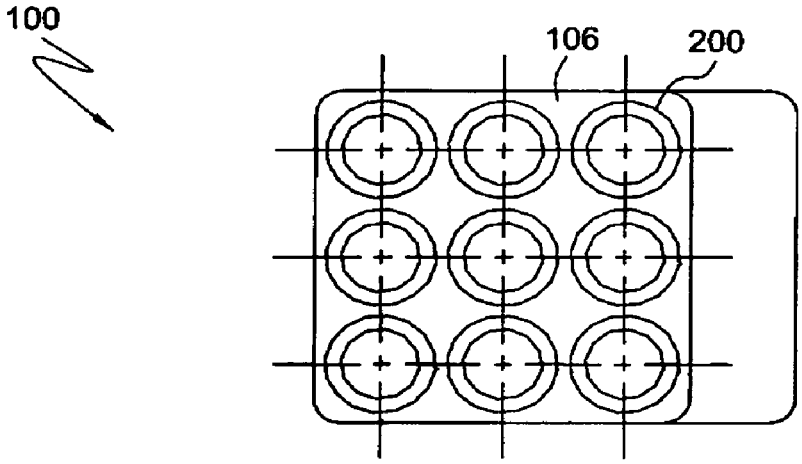
FIG. 2 is a view of a top surface of the milling insert.

FIG. 2 is a view of the milling surface 106 of the insert 100. As shown in FIG. 2, the insert 100 has a substantially square milling surface 106 with nine substantially circular concave formations 200 that aid the cutting process. However, the shape of the mill insert 100 and the milling surface 106 may be rectangular, circular, oval, triangular, or any desired shape. In addition, the formations 200, if present at all on the milling surface 106, may be concave or convex formations of any geometric shape.

Figure 3:
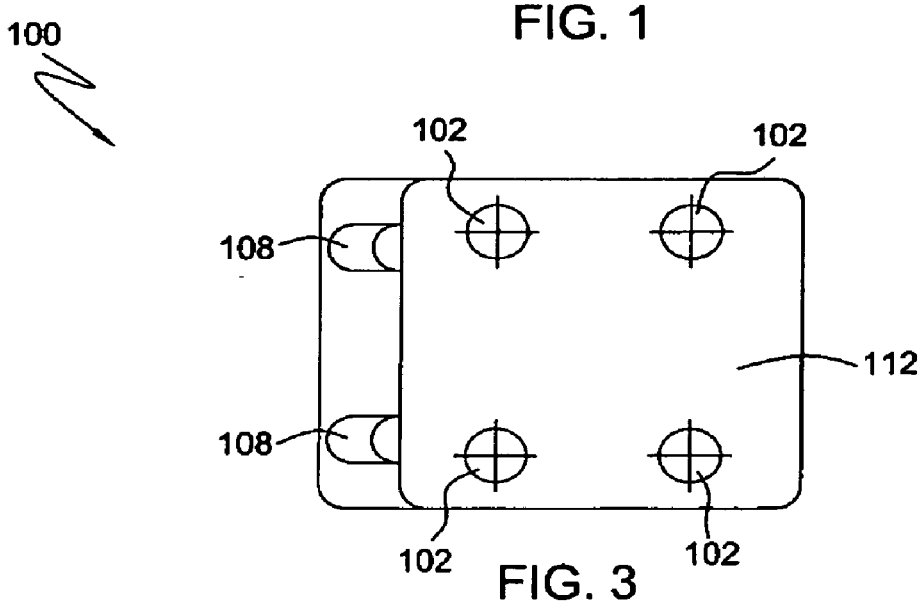
FIG. 3 is a view of a bottom surface of the milling insert.

FIG. 3 is a view of the base 112 of the mill insert 100 illustrating the legs 102 extending from the base 112. As shown, the legs 102 comprise four substantially round convex formations on the base 112. However, one skilled in the art could envision utilizing more or less legs 102 in different shapes and configurations.

Figure 4:
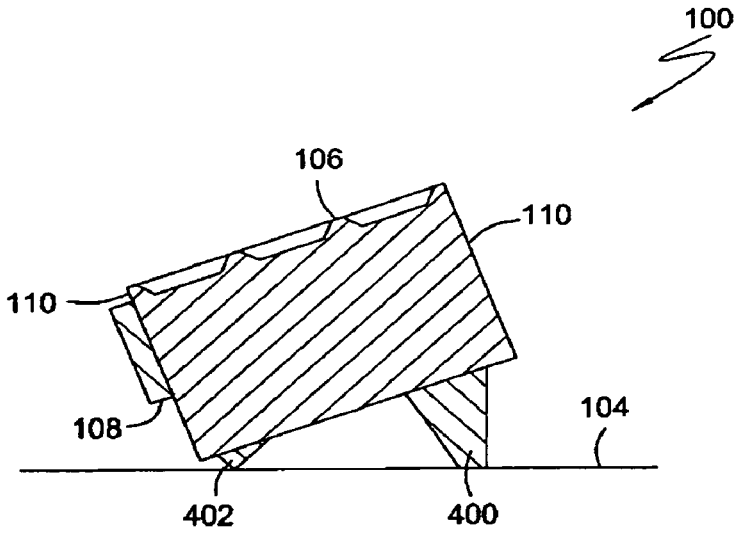
FIG. 4 is a section view of a side of another milling insert.

FIG. 4 illustrates another embodiment of an insert 100 that utilizes legs 400 and 402 to provide the correct cutting angle for a milling surface 106. Legs 400 are positioned on an opposite end of the insert 100 from legs 402. Since legs 400 are longer relative to legs 402, the milling surface has the proper cutting angle once mounted to the mill blade 104. Milling surface 106 forms a substantially perpendicular relationship with sides 110 of the insert 100. Therefore, the milling insert 100 shown in FIG. 4 provides substantially continuous support of the milling surface 106 since the sides 110 are substantially parallel to the force acting on the surface 106. Spacers 108 evenly distribute the bond to be made between inserts. Altering the length of the spacers 108 adjusts the bond strength created between the mill insert 100 and additional mill inserts (not shown) adjacently positioned.

In operation, a method for using a milling insert 100 as described herein with a milling tool includes attaching a plurality of adjacent milling inserts to a surface of the milling tool, running the milling tool into a wellbore to a position adjacent a material for milling, and rotating the milling tool, thereby milling the material. Each milling insert includes a milling surface angled relative to a mounting surface of the tool and sides substantially perpendicular to the milling surface.

While the foregoing is directed to embodiments of the present invention, other and further embodiments of the invention may be devised without departing from the basic scope thereof, and the scope thereof is determined by the claims that follow.

The invention claimed is:

1. A method for using a milling insert with a milling tool, comprising:

attaching a plurality of adjacent milling inserts to a mounting surface of the milling tool, each milling insert having:

a milling surface angled relative to a mounting surface of the tool;

sides substantially perpendicular to the milling surface;

a base connected to the sides;

at least one spacer extending from at least a portion of at least one of the sides, wherein the at least one spacer is in contact with another milling insert;

a plurality of legs extending from the base, thereby creating a separation between the base and the mounting surface;

running the milling tool into a wellbore to a position adjacent a material for milling; and rotating the milling tool, thereby milling the material.

2. The method of claim 1, wherein the attaching comprises brazing the milling inserts.

3. The method of claim 1, wherein the attaching comprises welding the milling inserts.

4. The method of claim 1, wherein the adjacent milling inserts are spaced apart from each other substantially 0.015 inches.

5. The method of claim 1, wherein the adjacent milling inserts are spaced from the milling tool substantially 0.005 inches.

6. The method of claim 1, wherein the adjacent milling inserts are spaced from the milling tool substantially 0.005 inches and the adjacent milling inserts are spaced apart from each other substantially 0.015 inches.

7. The method of claim 1, wherein a the base of the milling insert is parallel to the mounting surface of the tool.

8. The method of claim 1, further comprising breaking cuttings of the material milled to limit a length of the cuttings.

9. The method of claim 1, wherein the plurality of legs comprises a first leg extending from a first portion of the base and a second leg extending from a second portion of the base, wherein the first leg is longer than the second leg.

10. A cutting insert for a tool for wellbore milling operations, comprising:

a body having:

a milling surface angled relative to a mounting surface of the tool, a base, and sides substantially perpendicular to the milling surface;

a plurality of legs extending from the base thereby defining a space between the base and the mounting surface; and at least one spacer extending from at least a portion of at least one of the sides, wherein the at least one spacer is in contact with another cutting insert.

11. The cutting insert of claim 10, wherein the base is parallel to the mounting surface of the tool.

12. The cutting insert of claim 10, wherein the plurality of legs comprises a first leg extending from a first portion of the base and a second leg extending from a second portion of the base, wherein the first leg is longer than the second leg.

13. The cutting insert of claim 10, wherein the milling surface forms an angle relative to the base of between 7° and 8°.

14. The cutting insert of claim 10, wherein at least one leg extends about 0.005 inches from the base.

15. The cutting insert of claim 10, wherein the milling surface includes a chipbreaker.

16. A culling insert for a tool for wellbore milling operations, comprising:

a body having a milling surface, a base, and a side;

at least one spacing member extending a first distance from at least a portion of the side, wherein the at least one spacing member is in contact with another cutting insert; and a plurality of extension members extending a second distance from the base, wherein the first distance is longer than the second distance and wherein the base is spaced apart from a contact surface of the tool.

17. The cutting insert of claim 16, wherein the plurality of extension members extends about 0.005 inches from the base.

18. The culling insert of claim 16, wherein the at least one spacing member extends about 0.015 inches from the side.

19. The cutting insert of claim 16, wherein a bond strength between the base and the tool is stronger than a bond strength between adjacent inserts.

20. The cutting insert of claim 16, wherein the plurality of extension members comprises a plurality of legs.

* * * * *